US005307879A

United States Patent [19]

Kent

[11] Patent Number: 5,307,879

[45] Date of Patent: May 3, 1994

[54] POSITIVE LOCKDOWN FOR METAL SEAL

[75] Inventor: Peter M. Kent, Greengates, Scotland

[73] Assignee: ABB Vetco Gray Inc., Houston, Tex.

[21] Appl. No.: 9,903

[22] Filed: Jan. 26, 1993

[51] Int. Cl.[5] ..... E21B 33/04

[52] U.S. Cl. ..... 166/382; 166/115; 166/182; 166/208; 166/217; 166/387

[58] Field of Search ..... 166/115, 182, 208, 217, 166/387, 382

[56] References Cited

U.S. PATENT DOCUMENTS

| | | | |
|---|---|---|---|
| 4,496,162 | 1/1985 | McEver et al. | 277/9.5 |
| 4,595,063 | 6/1986 | Lennings et al. | 166/382 |
| 4,751,965 | 6/1988 | Cassity | 166/182 |
| 4,900,041 | 2/1990 | Hopkins et al. | 166/217 X |
| 4,949,786 | 8/1990 | Eckert et al. | 166/208 |
| 5,000,266 | 3/1991 | Saunders et al. | 166/387 |
| 5,038,865 | 8/1991 | Taylor et al. | 166/208 X |
| 5,070,942 | 12/1991 | McInnes | 166/116 |
| 5,110,144 | 5/1992 | Burton et al. | 166/115 X |
| 5,174,376 | 12/1992 | Lingeltham | 166/208 |

*Primary Examiner*—Hoang G. Dang
*Attorney, Agent, or Firm*—James E. Bradley

[57] ABSTRACT

A casing or tubing hanger has a metal seal which also incorporates a locking device which locks the seal to the wellhead housing. An annular recess is formed in the bore of the wellhead housing. The seal has an energizing ring that moves downward to set the seal. A split lock ring is carried by the assembly and moves between a contracted position to an expanded position located in the wellhead housing recess. A wedge ring is carried above the lock ring by the energizing ring. The wedge ring moves with the energizing ring and has a tapered surface that engages the lock ring to push it to the expanded position when the energizing ring moves to the lower position. The lower portion of the wedge ring has a thickness that is selected so as to allow the lower portion to deflect once the lock ring is in an expanded position. This allows the energizing ring to continue downward movement if necessary to fully set the seal.

10 Claims, 2 Drawing Sheets

POSITIVE LOCKDOWN FOR METAL SEAL

SUMMARY OF THE INVENTION

In this invention, a locking mechanism is carried with the seal assembly. An annular recess is formed in the bore of the wellhead housing. A split lock ring is carried by the energizing ring of the seal assembly. The split lock ring is movable between a contracted position to an expanded position located in the annular recess. A wedge ring is carried above the lock ring by the energizing ring for movement therewith. The wedge ring has a lower portion which has a tapered surface that engages the lock ring to push it to the expanded position. This occurs while the energizing ring is moving to the lower position to set the seal.

The lower portion of the wedge ring has a thickness that is selected to allow it to deflect once the lock ring is in the expanded position. This deflection allows the energizing ring to continue downward movement if necessary to fully set the seal. The locking mechanism does not interfere with any of the setting motion required to set the seal.

DETAILED DESCRIPTION OF THE INVENTION

Figure 1:
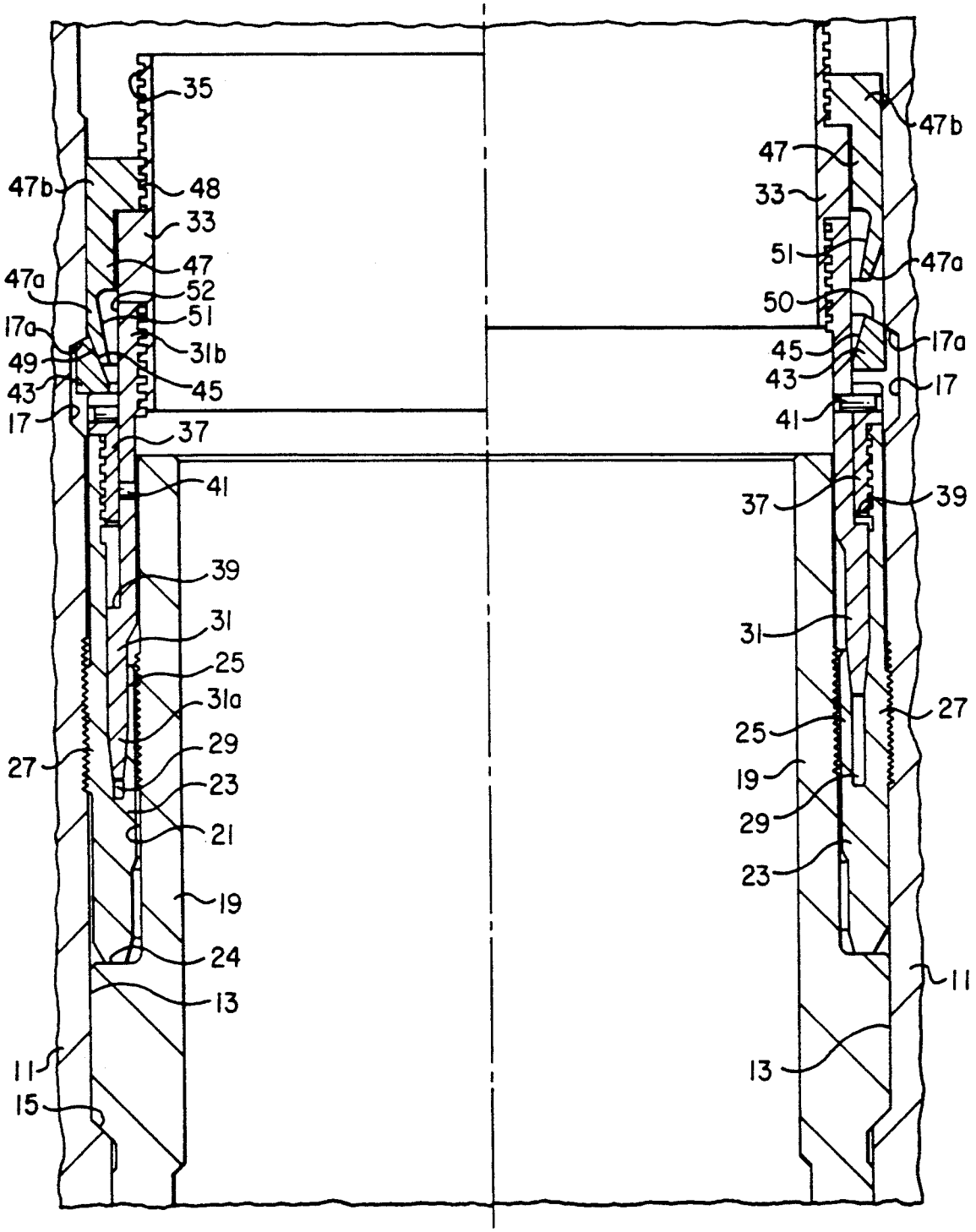
FIG. 1 is a sectional view of a seal assembly and locking mechanism constructed in accordance with this invention, shown the right side prior to setting, and on the left side in a set position.

Referring to the figures, wellhead housing 11 is a conventional large tubular member and is of a type that is often located subsea. Wellhead housing 11 has an axial internal cylindrical wall or bore 13. Bore 13 has an upward facing conical landing shoulder 15. An annular recess 17 extends around bore 13 a selected distance above landing shoulder 15. Recess 17 has a downward facing conical shoulder 17*a*.

A casing hanger 19 will be secured to a string of casing (not shown) and landed in the wellhead housing 11. Casing hanger 19 has a downward facing shoulder that lands on landing shoulder 15. Casing hanger 19 has an upper portion with an external cylindrical wall 21 that is spaced inward radially from the wall of bore 13. A seal 23 will seal the annular space between external wall 21 and bore 13. Seal 23 lands on an upward facing shoulder 24 located at the base of cylindrical wall 21.

Seal 23 may be a prior art type as shown. Seal 23 has inner and outer cylindrical legs 25, 27. Legs 25, 27 are spaced apart radially from each other, defining a wedge cavity 29. An energizing ring 31 will be pushed downward with great force to urge the legs 25, 27 radially apart from each other. Energizing ring 31 has a lower portion 31*a* that extends into cavity 29 to cause the setting of seal 23, as can be seen by comparing FIGS. 1 and 2. Preferably the inner and outer legs 25, 27 embed into wickers, which are small triangular shaped parallel grooves formed in bore 13 and external wall 21.

The upper portion 31*b* of energizing ring 31 extends above the upper end of casing hanger 19 and above the outer leg 27. In this embodiment, preferably energizing ring 31 includes an extension member 33 which secures by threads and extends upward from the upper portion 31*b*. Energizing ring 33 for the purposes herein may considered to be an integral part of the upper portion 31*b* of energizing ring 31. Energizing ring extension 33 has external threads 35 on its upper end. A running tool (not shown) may secure to threads 35 to move energizing ring 31 from the upper position shown on the right side of FIG. 1 to the lower position shown on the left side of FIG. 1.

Outer leg 27 of seal 23 extends above inner leg 25. A retainer ring 37 secures by threads to the upper end of outer leg 27. Retainer ring 37 is located on the inner side of outer leg 27. Energizing ring 31 has a shoulder 39 that will be spaced a short distance below retainer ring 37 when energizing ring 31 is in the upper position. A shear pin 41 extends between retainer ring 37 and energizing ring 31 to initially hold energizing ring 31 in the upper position. The setting action will cause shear pin 41 to shear, as indicated on the left side of FIG. 1.

The lockdown mechanism includes a split lock ring 43 that is carried on top of retainer ring 37. Split lock ring 43 has a split in it that enables it to move radially between the contracted position shown on the right side, to the expanded position shown on the left side of FIG. 1. Split lock ring 43 is resilient and biased so that it will naturally contract to the retracted position shown on the right side. Split lock ring 43 has an inward facing conical surface 45. Split lock ring 43 has an upward and outward facing conical shoulder 50 (FIG. 2) that is inclined so as to slidingly mate with recess shoulder 17*a*.

Figure 2:
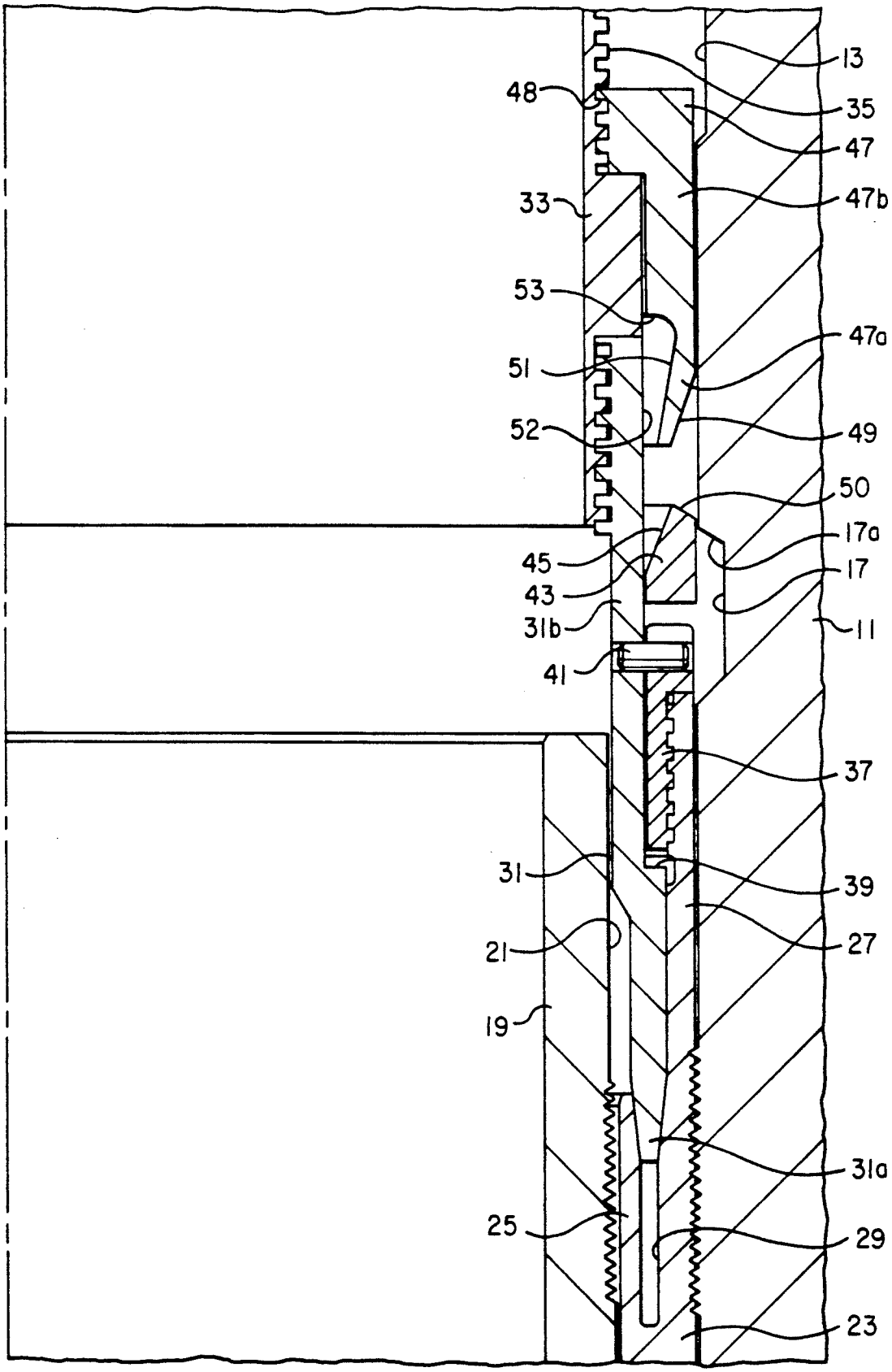
FIG. 2 is an enlarged view of a portion of the seal assembly and locking mechanism of FIG. 1, shown prior to setting.

A metal wedge ring 47 is employed to push the lock ring 43 to the expanded position. Wedge ring 47 is carried above lock ring 43 and has threads 48 that secure to threads 35 of energizing ring extension 31. Wedge ring 47 has a lower portion 47*a* and an upper portion 47*b*. Lower portion 47*a* has an outward facing conical surface 49 that has the same angle of taper as the conical surface 45 of lock ring 43. Lower portion 47*a* has an inner wall 51 that is spaced radically outward from the external wall 52 of energizing ring upper portion 31*b*. Exterior wall 52 is a cylindrical wall. Inner wall 51 of wedge ring 47, however, is tapered or conical. As shown more clearly in FIG. 2, the degree of taper of inner wall 51 is steeper than the degree of taper of wedge ring tapered surface 49. In the embodiment shown, wedge ring tapered surface 49 is at an angle of about 20 degrees relative to the axis of bore 13, while inner wall 51 is at an angle of about 10 degrees relative to the axis of bore 13. Inner wall 51 extends upward above the upper termination of tapered surface 49. Inner wall 51 joins a downward facing shoulder 53 (FIG. 2). A cavity will exist between the inner wall 51 and energizing ring exterior wall 52. Shoulder 53 defines the upper margin of wedge ring lower portion 47*a*. The radial cross sectional thickness of upper portion 47*b* above shoulder 53 is substantially equal to the distance between energizing ring exterior wall 52 and bore 13. The radial cross sectional thickness of the lower portion 47*a* varies, but at all points, it is less than the cross sectional thickness of the upper portion 47*b*. The cross sectional thickness of lower portion 47*a* is at its maximum less than one-half the cross sectional thickness of the upper portion 47*b*.

The inclination of inner wall 51 and the cross sectional thickness of lower portion 47*a* are selected to cause the lower portion 47*a* to deflect if pressed against lock ring 43 with sufficient forces. If lock ring 43 has fully wedged against shoulder 17*a*, continued downward movement of energizing ring 31 bends lower portion 47*a* slightly upward, and allows continued downward travel of energizing ring 31 if necessary for setting the seal 23. The deflection of the inner wall 51 may be only a few thousandths of an inch, or in some instances because of tolerances, deflection may hardly occur at all. The deflection of lower portion 47*a* can exceed the yield strength of the metal of lower portion 47*a*, resulting in permanent deformation. The amount of downward travel of energizing ring 31 after lower portion 47*a* begins to deflect may be typically in the range from 0.030 to 0.050 inch.

In operation, casing hanger 19 will be lowered into bore 13 and landed on landing shoulder 15. The casing will be cemented into place in a conventional manner. A running tool will be secured to threads 35 of energizing ring extension 33 for lowering the seal 23 into the annular space between external wall 21 and bore 13. Initially shear pin 41 will hold energizing ring 31 in the upper position shown in the right side. Initially split lock ring 43 will be contracted in contact with exterior wall 52 of energizing ring 31. Wedge ring 47 will be located above lock ring 43.

Seal 23 will be positioned on shoulder 24 between external wall 21 and bore 13. After seal 23 lands on shoulder 24, the running tool will push downward on wedge ring 47. This downward force transmits through energizing ring extension 33 to energizing ring 31. Shear pin 41 will shear, causing energizing ring 31 to move downward. Lower portion 31*a* of energizing ring 31 will extend further downward in the wedge cavity 29.

As the energizing ring 31 moves downward, wedge ring tapered surface 49 will contact lock ring tapered surface 45, pushing lock ring 43 outward into recess 17. The lower side of wedge ring 47 will contact retainer ring 37. The upper shoulder 50 of wedge ring 43 will slide outward in tight engagement with recess shoulder 17*a*. When the force required to push lock ring 43 further outward reaches a predetermined amount, the lower portion 47*a* of wedge ring 47 will begin to deflect. The deflection will continue as long as energizing ring 31 moves downward. Energizing ring 31 will move downward until a selected force for setting seal 23 has been reached. Depending on tolerances, this continued downward movement of energizing ring 31 after wedge ring lower portion 47*a* begins to deflect may occur only a few thousands of an inch. The deflection of lower portion 47*a* may be elastic, or it may permanently deform lower portion 47*a* if the continued downward movement of energizing ring 31 is sufficient. Lock ring 43 will not be moved any further into recess 17 during deflection of wedge ring lower portion 47*a*.

Once a selected force has been reached, the seal inner and outer legs 25, 27 will be embedded in the wickers of the exterior wall 21 and bore 13. A preload compressive force will exist through seal outer leg 27, retainer ring 37, lock ring 43 and shoulder 17*a*. By locking the seal 23, the casing hanger 19 is also locked to the wellhead housing 11.

If one wishes to retrieve the seal assembly, a running tool will pull upward on the energizing ring extension 33. The upward pull moves wedge ring lower portion 47*a* upward, allowing lock ring 43 to contract out of recess 17 due to its natural resilience. The lower portion 31*a* of energizing ring 31 will move upward in wedge cavity 29. The energizing ring shoulder 39 will contact the lower end of retainer ring 37. Continued upward force causes the energizing ring 31 to lift the seal 23 due to the contact of shoulder 39 with retainer ring 37. If desired, casing hanger 19 could then be removed in a conventional manner.

This invention has significant advantages. The casing hanger seal is positively locked to the wellhead housing. This enables the seal to have a higher pressure rating. The locking mechanism operates simultaneously with the energizing of the seal. The locking mechanism will not interfere with full setting action of the seal because of the deflection that occurs once the lock ring reaches the outermost position. The lockdown assembly could be employed with a tubing hanger seal as well.

While the invention has been shown in only one of its forms, it should be apparent to those skilled in the art that it is not so limited, but is susceptible to various changes without departing from the scope of the invention.

I claim:

1. In a well assembly having a wellhead housing with an axial bore, a hanger secured to a string of conduit and supported in the bore, a seal located between the hanger and the bore, and an energizing ring which is moved from an upper position to a lower position to set the seal, an improved means for locking the seal to the wellhead housing, comprising in combination:

an annular recess formed in the bore of the wellhead housing;

a split lock ring carried by the energizing ring and being movable between a contracted position to an expanded position located in the recess; and a wedge ring carried above the lock ring by the energizing ring for movement therewith, the wedge ring having a lower portion which has a tapered surface that engages the lock ring to push it to the expanded position when the energizing ring moves to the lower position, the lower portion having a thickness that is selected so as to allow the lower portion to deflect once the lock ring is in the expanded position to allow the energizing ring to continue downward movement if necessary to fully set the seal.

2. The well assembly according to claim 1 wherein the lower portion of the wedge ring has an annular internal cavity located radially inward of the tapered surface, the cavity being dimensioned so as to allow said deflection.

3. The well assembly according to claim 1 wherein the lower portion of the wedge ring has an annular internal cavity located radially inward of the tapered surface, the cavity being defined by an inward facing wall that is inclined relative to the axis of the bore so as to allow said deflection.

4. The well assembly according to claim 1 wherein the energizing ring has an upper portion that extends upward radially inward of the lower portion of the wedge ring; and the lower portion of the wedge ring has an inward facing wall that is spaced radially outward from the upper portion of the energizing ring, defining a cavity so as to allow said deflection.

5. In a well assembly having a wellhead housing having an axial bore, a hanger secured to a string of conduit and supported in the bore, a metal seal located between the hanger and the bore, the seal having radially spaced apart inner and outer walls, and an energizing ring which is moved from an upper position to a lower position forcing the inner and outer walls further radially apart to set the seal, an improved means for locking the seal to the wellhead housing, comprising in combination:

an annular recess formed in the bore of the wellhead housing;

a split lock ring carried by the energizing ring above the inner and outer walls of the seal and being movable between a contracted position to an expanded position located in the recess, the lock ring having an upward and inward facing tapered surface; and a wedge ring carried above the lock ring by the energizing ring for movement therewith, the wedge ring having a lower portion which has a downward and outward facing tapered surface that engages the tapered surface of the lock ring to push it to the expanded position when the energizing ring moves to the lower position, the lower portion having an inward facing wall that is spaced radially outward from the energizing ring, defining a cavity so as to allow the lower portion to deflect once the lock ring is in the expanded position, to allow the energizing ring to continue downward movement if necessary to fully set the seal.

6. The well assembly according to claim 5 wherein the inward facing wall of the wedge ring inclines relative to the axis of the bore.

7. The well assembly according to claim 5 wherein the wedge ring has an upper portion with an upper cross-sectional thickness and the lower portion of the wedge ring has a lower cross-sectional thickness between the tapered surface of the wedge ring and the inward facing wall of the wedge ring that is substantially less than the upper cross-sectional thickness.

8. The well assembly according to claim 5 wherein the energizing ring has a set of external threads and the wedge ring has an upper potion having a set of internal threads that engage the external threads.

9. The well assembly according to claim 5 wherein the inward facing wall of the wedge ring inclines relative to the axis of the bore at an inclination that differs from the tapered surface of the wedge ring.

10. A method of locking a seal assembly for a hanger to a wellhead housing, the wellhead housing having an axial bore, the hanger being secured to a string of conduit and supported in the bore, the method comprising:

providing the seal assembly with an axially movable energizing ring, a split lock ring, and a wedge ring which moves in unison with the energizing ring and has a lower portion with a tapered surface;

providing an annular recess formed in the bore of the wellhead housing;

landing the seal assembly on the hanger, moving the energizing ring and wedge ring downward, causing the wedge ring to push the lock ring to an expanded position in engagement with the recess, then deflecting the lower portion of the wedge ring once the lock ring has fully engaged the recess, and continuing downward movement of the energizing ring if necessary to fully set the seal.

* * * * *

UNITED STATES PATENT AND TRADEMARK OFFICE

CERTIFICATE OF CORRECTION

PATENT NO. : 5,307,879

DATED : May 3, 1994

INVENTOR(S) : Peter M. Kent

It is certified that error appears in the above-indentified patent and that said Letters Patent is hereby corrected as shown below:

Column 1, line 4, before "Summary Of The Invention" insert the following"

BACKGROUND OF THE INVENTION

1. Field of the invention:

This invention relates to casing hanger and tubing hanger seals for wellhead equipment, and in particular to a locking device for locking a hanger seal in the wellhead.

2. Description of the Prior Art:

In many well completion techniques, the casing will be supported in a wellhead housing by a casing hanger. The casing hanger lands on a shoulder in the bore of the wellhead housing. The casing is cemented in place. Then a seal seals between an exterior wall of the casing hanger and the bore of the wellhead housing. One type of seal employed is a metal-to-metal seal, having inner and outer legs that are wedged apart by an energizing ring.

UNITED STATES PATENT AND TRADEMARK OFFICE

CERTIFICATE OF CORRECTION

PATENT NO. : 5,307,879

DATED : May 3, 1994

INVENTOR(S) : Peter M. Kent

It is certified that error appears in the above-indentified patent and that said Letters Patent is hereby corrected as shown below:

A casing hanger seal needs to be locked in place to prevent annulus pressure from pushing the seal upward. In the metal-to-metal type of seal referred to above, the friction force of the legs against the casing hanger and the wellhead housing bore provides the lockdown. While workable, an additional lockdown mechanism might increase the pressure rating of the seal. Separate lockdown latches of various types have been used for other types of casing hanger seals in the past.

Signed and Sealed this

Twenty-ninth Day of November, 1994

*Attest:*

Bruce Lehman

BRUCE LEHMAN

*Attesting Officer*

*Commissioner of Patents and Trademarks*